US011276911B2

(12) United States Patent
Li et al.

(10) Patent No.: US 11,276,911 B2
(45) Date of Patent: Mar. 15, 2022

(54) HIGH-DENSITY LOW-LOSS CABLE AND CONNECTOR ASSEMBLY

(71) Applicant: Intel Corporation, Santa Clara, CA (US)

(72) Inventors: Jingbo Li, Portland, OR (US); Kai Xiao, Portland, OR (US); Howard Heck, Tigard, OR (US); Kai Wang, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 637 days.

(21) Appl. No.: 16/164,352

(22) Filed: Oct. 18, 2018

(65) Prior Publication Data

US 2019/0051963 A1 Feb. 14, 2019

(51) Int. Cl.

| | |
|---|---|
| ***H01P 5/02*** | (2006.01) |
| ***H01B 7/04*** | (2006.01) |
| ***H01P 3/02*** | (2006.01) |
| ***H01R 12/73*** | (2011.01) |
| ***H01P 5/08*** | (2006.01) |
| ***H01R 24/60*** | (2011.01) |

(52) U.S. Cl.

CPC ..... *H01P 5/022* (2013.01); *H01B 7/04* (2013.01); *H01P 3/02* (2013.01); *H01P 5/026* (2013.01); *H01P 5/085* (2013.01); *H01R 12/73* (2013.01); *H01R 24/60* (2013.01)

(58) Field of Classification Search

CPC ..... H01P 5/022; H01P 5/085; H01P 5/026; H01P 3/02; H01R 12/73; H01R 24/60; H01B 7/04

See application file for complete search history.

(56) References Cited

U.S. PATENT DOCUMENTS

| | | | | |
|---|---|---|---|---|
| 5,892,365 | A * | 4/1999 | Bailleul | G01D 5/241 324/690 |
| 7,230,214 | B2 * | 6/2007 | Kirby | H01R 4/72 174/76 |
| 2003/0194889 | A1 * | 10/2003 | Golat | H01R 12/73 439/79 |
| 2008/0236867 | A1 * | 10/2008 | Varkey | H01B 7/046 174/115 |
| 2010/0098425 | A1 * | 4/2010 | Kewitsch | G06K 7/10178 398/116 |

(Continued)

*Primary Examiner* — Gary F Paumen

(74) *Attorney, Agent, or Firm* — Schwabe, Williamson & Wyatt, P.C.

(57) ABSTRACT

In accordance with embodiments disclosed herein, there is provided a high-density low-loss cable and connector assembly. A cable assembly includes a first cable connector, a bulk cable section, and a first cable transition section. The bulk cable section includes a first plurality of conductive wires of a first wire thickness. The first cable transition section includes a second plurality of conductive wires that has a first distal end connected to the bulk cable section and a second distal end connected to the first cable connector. Each of the second plurality of conductive wires transitions from the first wire thickness at the first distal end to a second wire thickness that is less than the first wire thickness at the second distal end. Each of the second plurality of conductive wires in the first distal end is connected to a corresponding conductive wire of the first plurality of conductive wires.

20 Claims, 5 Drawing Sheets

(56) References Cited

U.S. PATENT DOCUMENTS

| | | | | |
|---|---|---|---|---|
| 2010/0184325 | A1* | 7/2010 | Xian | H01R 13/56 439/577 |
| 2015/0187462 | A1* | 7/2015 | Kondo | H01R 43/16 310/71 |
| 2019/0051963 | A1* | 2/2019 | Li | H01P 3/02 |
| 2020/0035407 | A1* | 1/2020 | Urushihara | C09D 179/08 |

* cited by examiner

HIGH-DENSITY LOW-LOSS CABLE AND CONNECTOR ASSEMBLY

DESCRIPTION OF EMBODIMENTS

Figure 1A:
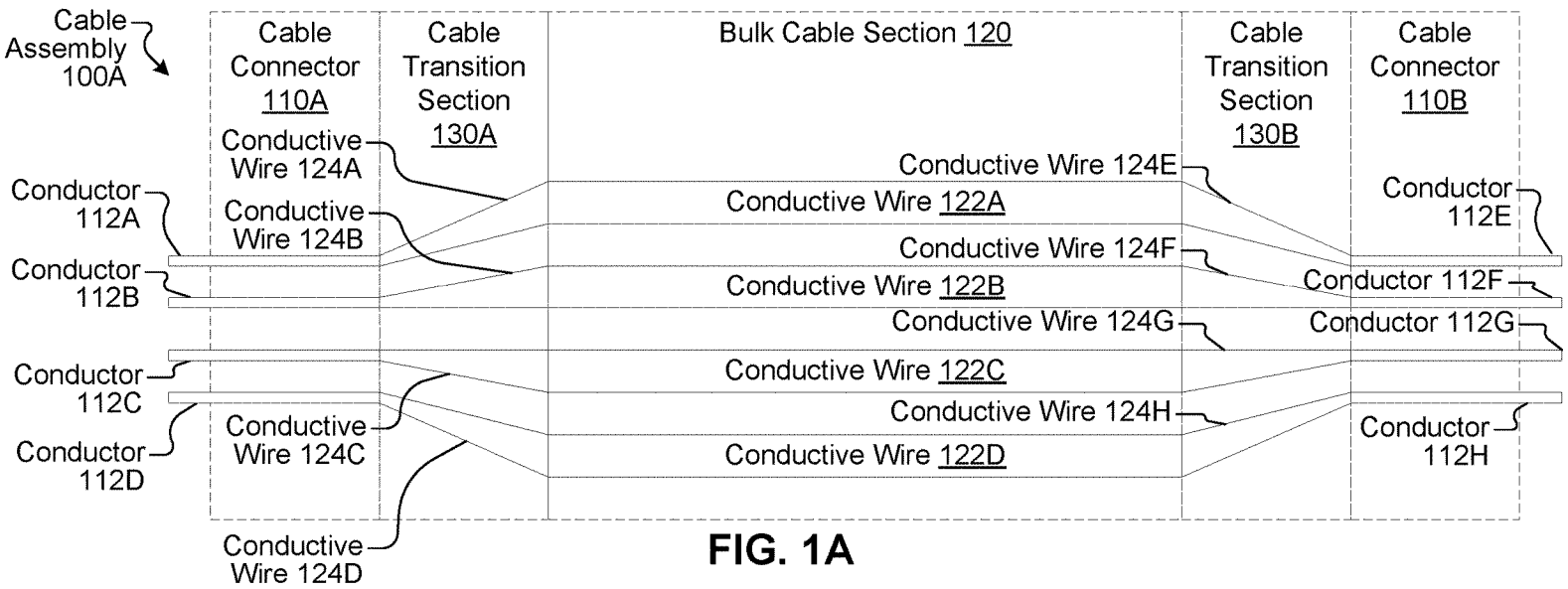
FIG. 1A illustrates a cable assembly including a cable transition section, according to certain embodiments.

Described herein are technologies directed to a high-density low-loss cable and connector assembly. Systems may transfer signals at speeds of high-speed differential input/output (I/O) technologies (e.g., peripheral component interconnect Express® (PCIe®), unified physical layer interface (UPI), Ethernet (ENET), etc.). These speeds have increased from a few gigabits per second (Gbps) to several tens of Gbps in recent years. Higher speeds can cause a higher channel insertion loss (e.g., loss of signal power). Increase in the distance between the component that is transmitting the signals and the component that is receiving the signals can also cause an increase in insertion loss.

To transfer signals at higher speeds and/or at greater distances, cable assemblies may be used. Cable assemblies include a first connector, a second connector, and a bulk cable section (e.g., including conductive wires) that is disposed between the first connector and the second connector. The bulk cable section may make up the majority of the loss of the cable assembly and the cable assembly may be a major contributor to channel loss. Thicker conductive wires in a bulk cable section of a cable assembly may be used to decrease insertion loss. Systems may also have decreased component size to enable high-density and high-performance systems. Thicker conductive wires of a cable assembly cannot mount to a small form factor connector or a connector with high-density pins (e.g., smaller size of pins, smaller pitch between pins). Higher insertion loss (e.g., due to higher speeds and/or longer distances) and decreased component size create a pair of conflicting requirements for cable design. Cable assemblies are to have low insertion loss at the Nyquist frequency (e.g., tens of gigahertz (GHz)) and also have smaller form factor with high-density pin arrangement.

The devices, systems, and methods, as disclosed herein, provide a high-density low-loss cable and connector assembly. A cable assembly may include a first cable connector to couple to a first component and a second cable connector to couple to a second component. The cable assembly may include a bulk cable section including first conductive wires of a first wire thickness. The first wire thickness of the bulk cable section may allow for a lower insertion loss. The cable assembly may include a cable transition section including second conductive wires that have a first wire thickness at a first distal end and have a second wire thickness that is less than the first wire thickness at a second distal end. In some embodiments, the second distal end of the cable transition section may connect to a cable connector that has a smaller form factor or high-density pin arrangement (e.g., connect a small form factor connector to the main bulk cable through gradually increasing wire thickness, increase from thin wire (large gauge number) to thick wire (small gauge number)). In some embodiments, the cable transition section may be located at a section of the cable assembly that is likely to be bent (e.g., to make management of thick cable easier).

A cable assembly with one or more cable transition sections may allow for low insertion loss and connection to high-density systems. A cable assembly with one or more transition sections may also allow transmitting of signals at higher speeds and over longer distances.

Figure 1B:
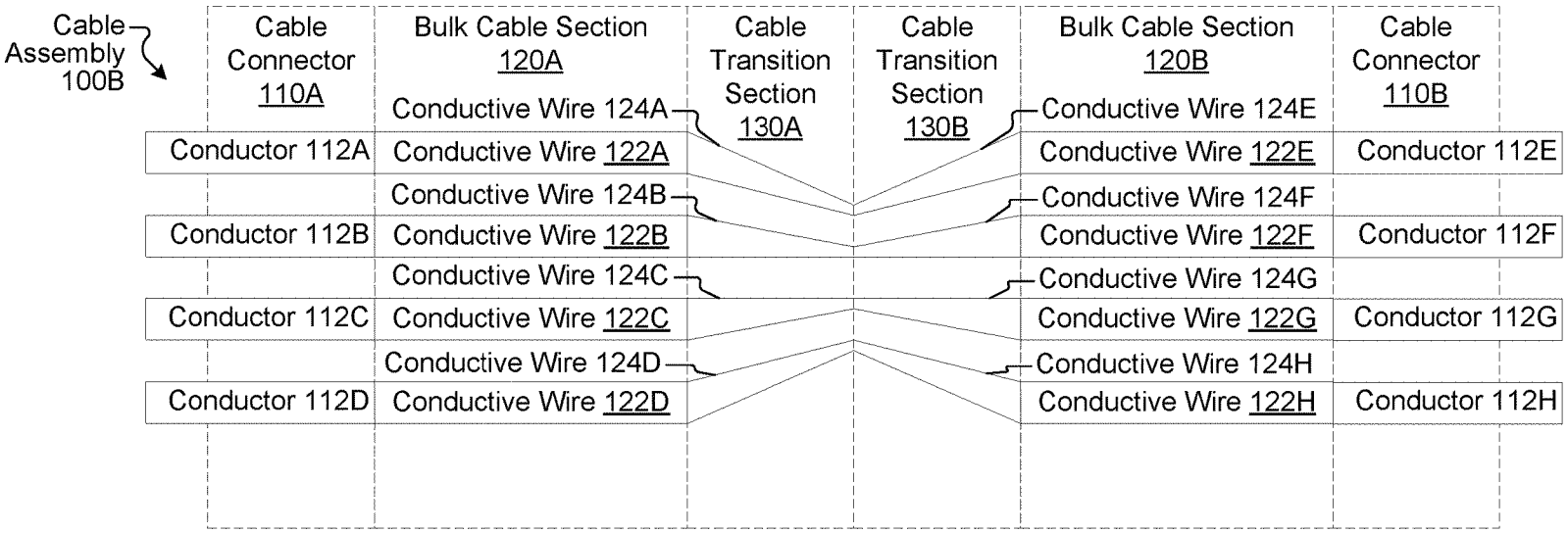
FIG. 1B illustrates a cable assembly including a cable transition section, according to certain embodiments.

FIGS. 1A-B illustrates cable assemblies 100A and 100B (hereinafter "cable assembly 100") including one or more corresponding cable transition sections 130, according to certain embodiments. The cable assembly 100 may include a first cable connector 110A and a second cable connector 110B (hereinafter "cable connectors 110"). In some embodiments, each cable connector 110 may include a printed circuit board (PCB) and a plurality of conductors 112 (e.g., contacts, pins, etc.) disposed on the printed circuit board.

Figure 5:
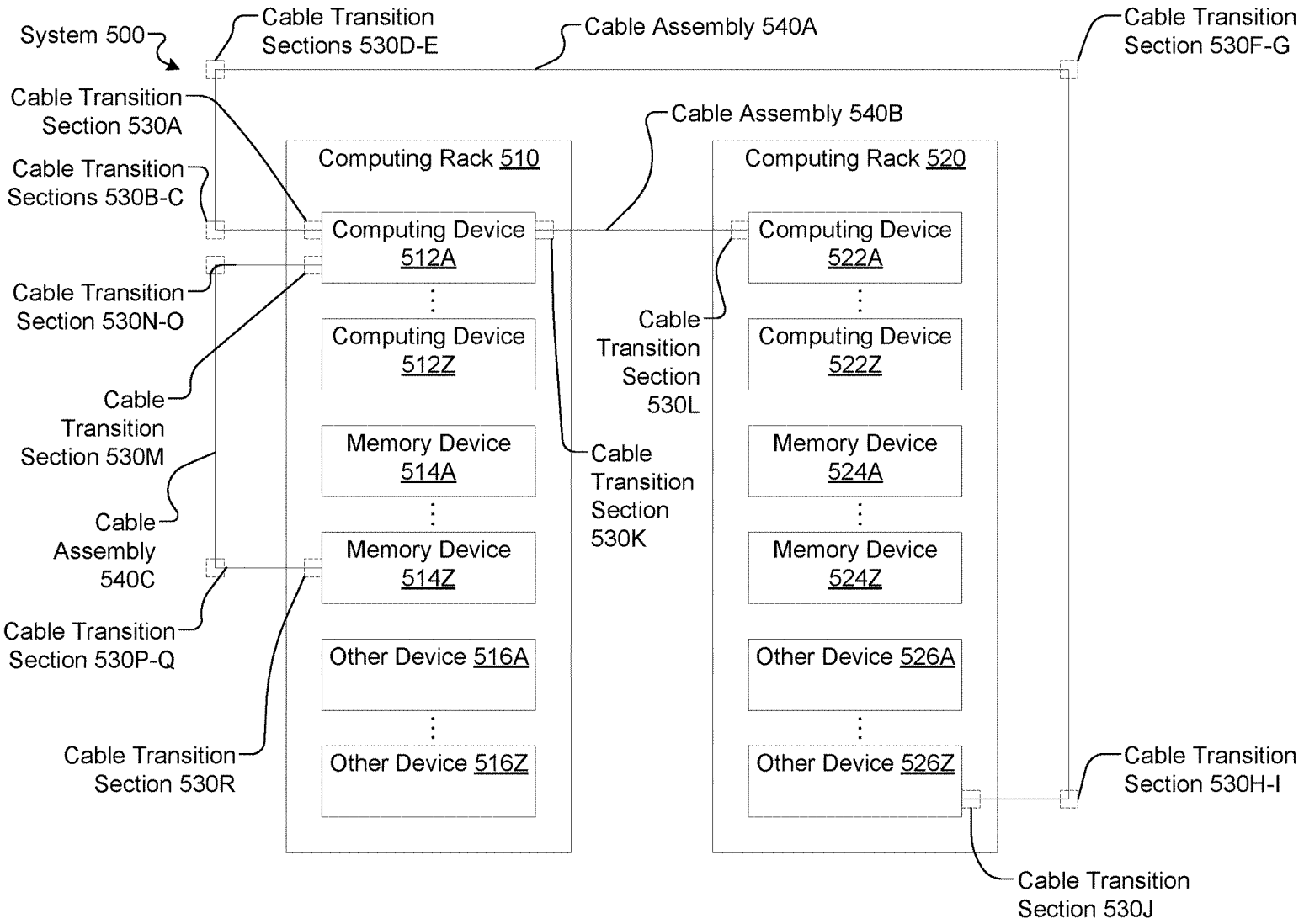
FIG. 5 illustrates a system including cable assemblies that include a corresponding cable transition section, according to certain embodiments.

Each cable connector 110 may connect to a different component, such as a computing device, a memory device, end-point device, or other type of device (e.g., see FIG. 5). A first component may transmit signals to a second component via the cable assembly 100. Components can transmit signals to each other using a high speed input/output (IO) technology (e.g., PCIE®, Universal Serial Bus (USB), Ethernet, etc.) via cable assembly 100. In some embodiments, components can transmit single-ended signals to each other via the cable assembly 100. In some embodiments, components can transmit differential signals to each other via cable assembly 100.

The cable assembly 100 may include one or more bulk cable sections 120 and one or more cable transition sections 130. Each bulk cable section 120 includes two or more conductive wires 122 and each cable transition section 130 contains two or more corresponding conductive wires 124. Each conductive wire 122 of the one or more bulk cable sections 120 may have a first thickness. A first distal end of each conductive wire 124 of each cable transition section 130 may have the first thickness and a second distal end of conductive wire 124 may have a second thickness that is smaller than the first thickness. In some embodiments, the first thickness may be 26, 28, 30, or 32 gauge (e.g., thicker conductive wire for low loss) and the second thickness may be 32, 34, 36, or 38 gauge (e.g., narrower conductive wire for a high-density connection, narrower conductive wire to be more bendable). Cable assembly 100 may be used for transmitting signals above certain speeds (e.g., ten Gbps or greater) and/or over greater than a threshold distance (e.g., cable assembly 100 may be at least half a meter long).

The first distal end of each conductive wire 124 of a cable transition section 130 may be connected to a corresponding distal end of a corresponding conductive wire 122 of the bulk cable section 120. In some embodiments, conductive wire 122 and conductive wire 124 are two separate wires, where the first distal end of the conductive wire 124 is joined to a corresponding distal end of a corresponding conductive wire 122. Conductive wire 122 and conductive wire 124 may be joined one or more of mechanically, chemically, via soldering, via adhesion, etc. In some embodiments, conductive wire 122 and conductive wire 124 are two portions of the same wire (e.g., a non-joined wire). For example, a portion of conductive wire 122 may be machined to form conductive wire 124 (e.g., a tapered portion of conductive wire 124, a stepped portion of conductive wire 124, etc.). In another example, a portion of conductive wire 122 may be stretched (e.g., elongated, drawn through a hole in a die or draw plate) to form conductive wire 124. In another example, the conductive wire 124 may be manufactured to have a portion that is tapered or stepped (e.g., to form conductive wire 124 in the conductive wire 122).

A first distal end of each conductive wire 124 in the cable transition section 130 may have a first thickness and may be connected to a distal end of a conductive wire 122 of the first thickness. A second distal end of each conductive wire 124 may have a second thickness that is smaller than the first thickness.

As illustrated in FIG. 1A, in some embodiments, a cable transition section 130 may be proximate a cable connector 110. In some embodiments, a corresponding second distal end of each conductive wire 124 in a cable transition section 130 may be connected to a corresponding conductor 112 of a cable connector 110 (e.g., a small form factor cable connector, a high-density pin cable connector, a high-density contact cable connector, etc.).

In some embodiments, at least a portion of the cable connector 110 is disposed within a housing. The cable transition section 130 may be disposed outside of the housing. The cable transition section 130 may be more bendable than the bulk cable section 120. The cable transition section 130 may allow the orientation of the cable connector 110 to be changed without changing the orientation of the bulk cable section 120. In some embodiments, at least a portion of the cable connector 110 and the cable transition section 130 are disposed within a common housing. At least a portion of the conductors 112 of cable connector 110 may be exposed to engage with a component (e.g., PCB, etc.).

For example, conductor 112A (e.g., that is substantially a second thickness) may connect to a second distal end of a conductive wire 124A that is the second thickness (e.g., 32, 34, 36, or 38 gauge). The thickness of the conductive wire 124A may increase (e.g., gradual, tapered, stepped, etc.) as it extends away from the conductor 112A to a first distal end that is a first thickness (e.g., 26, 28, 30, or 32 gauge) that is greater than the second thickness. The first distal end of conductor 112A may connect to a distal end of a conductive wire 122A that is the first thickness.

As illustrated in FIG. 1B, in some embodiments, a pair of cable transition sections 130 may be disposed between two bulk cable sections 120. In some embodiments, a corresponding second distal end of each conductive wire 124 in a transition section 130A may be connected to a corresponding second distal end of each conductive wire 124 in another transition section 130B. Cable transition sections 130 may be disposed in the cable assembly 100 (e.g., between bulk cable sections 120) where the cable assembly is likely to be bent to make management of the cable assembly easier. In some embodiments, two or more pairs of cable transition sections 130 (e.g., cable transition sections 130A-B in FIG. 1B) may be distributed along the cable assembly 100 (e.g., evenly distributed throughout cable assembly 100). In some embodiments, a corresponding distal end (e.g., proximate the cable connector 110A) of each conductive wire 122 in bulk cable section 120 may be connected to a corresponding conductor 112 of a cable connector 110.

For example, conductor 112A (e.g., that is substantially a first thickness) may connect to a first distal end of a conductive wire 122A that is the first thickness (e.g., 26, 28, 30, or 32 gauge). A second distal end of the conductive wire 122A that is also the first thickness (e.g., conductive wire 122A may be substantially the same thickness along the entire length of the conductive wire) may connect to a first distal end of a conductive wire 124A that is the first thickness. The thickness of the conductive wire 124A may decrease (e.g., gradual, tapered, stepped, etc.) as it extends away from the conductive wire 122A to a second distal end that is a second thickness (e.g., 32, 34, 36, or 38 gauge) that is less than the first thickness. A second distal end of a conductive wire 124E that is the second thickness may connect to the second distal end of conductive wire 124A that is also the second thickness. The thickness of the conductive wire 124E may increase (e.g., gradual, tapered, stepped, etc.) as it extends away from the conductive wire 124A to a first distal end that is a first thickness and connects to a distal end of a conductive wire 122E that is the first thickness.

A cable assembly 100 may have one or more cable transition sections 130. In some embodiments, a cable assembly 100 may have a corresponding cable transition section 130 proximate each cable connector 110. In some embodiments, a cable assembly 100 may have a cable transition section 130 proximate cable connector 110A without having a cable transition section 130 proximate cable connector 110B. In some embodiments, cable assembly 100 may have cable transition sections 130 disposed between bulk cable sections 120 without having cable transition sections 130 proximate cable connectors 110. In some embodiments, cable assembly 100 may have cable transition sections 130 disposed between bulk cable sections 120 and may also have cable transition sections 130 proximate cable connectors 110.

Figure 2:
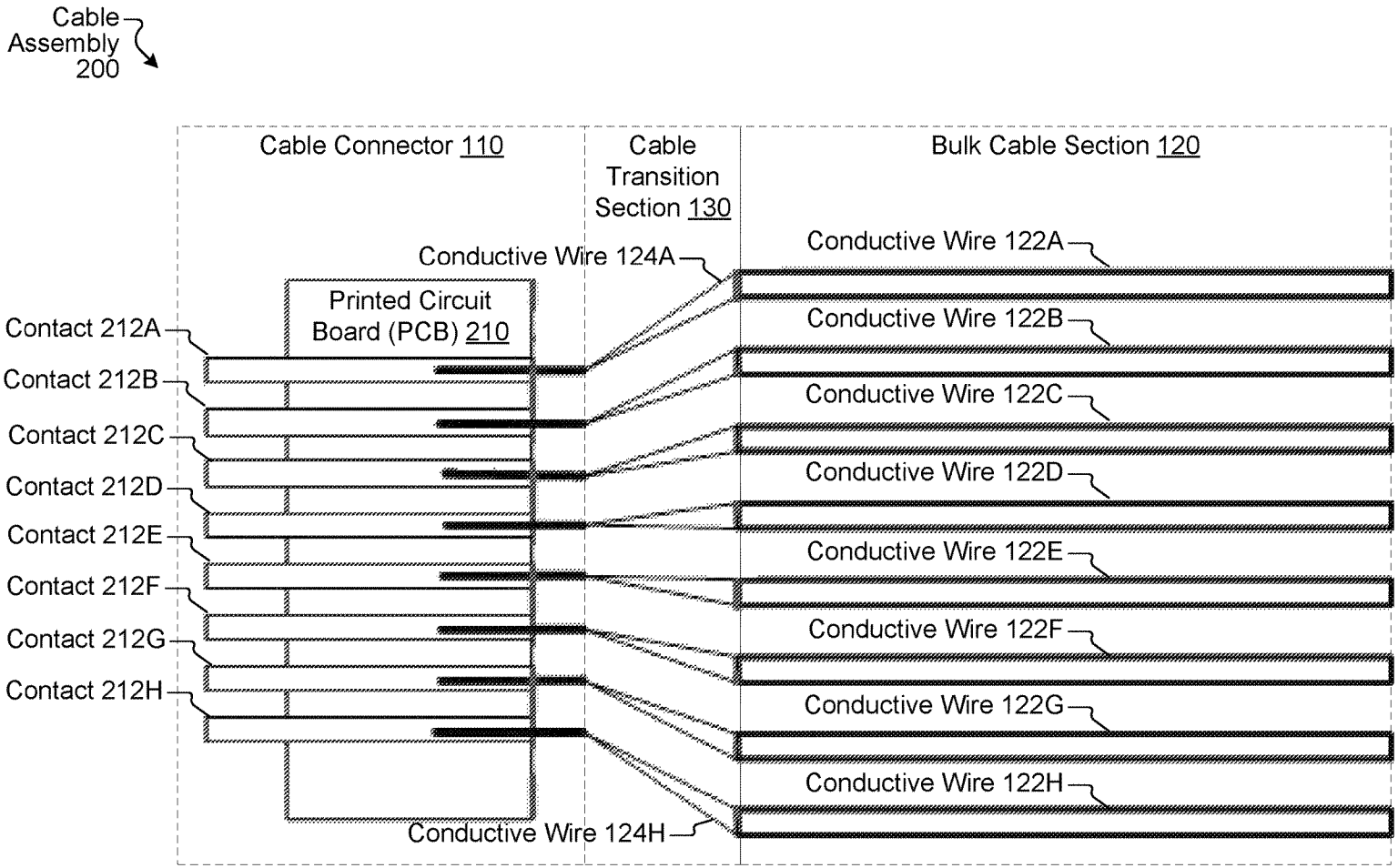
FIG. 2 illustrates a cable assembly including a cable transition section, according to certain embodiments.

FIG. 2 illustrates a cable assembly 200 including a cable transition section 130, according to certain embodiments. The cable assembly 200 may include one or more components and functionalities of cable assembly 100A of FIG. 1A and cable assembly 100B of FIG. 1B. The bulk cable section 120 may include at least two conductive wires 122 and the cable transition section 130 may include at least two conductive wires 124 (e.g., the same amount of conductive wires 124 as conductive wires 122). A first dielectric material may be disposed between the conductive wires 122. A second dielectric material may be disposed between the conductive wires 124. In some embodiments, the first dielectric material is the same as the second dielectric material. In some embodiments, the first dielectric material and the second dielectric material are different types of dielectric material.

In the cable transition section 130, each conductive wire 124 may decrease wire thickness from a first distal end contacting a corresponding conductive wire 122 to a second distal end contacting the cable connector 110. The conductive wires 122 in the bulk cable section 120 may have a first spacing (e.g., have first relative distances away from each other). The conductive wires 124 in the cable transition section 130 may have a second spacing that is relative to the first spacing (e.g., maintain the first relative distances away from each other). The dielectric-to-conductive-wire ratio may be in the same in the cable transition section 130 and the bulk cable section 120.

The first distal end of each of the conductive wires 124 may be connected to a corresponding conductive wire 122. A second distal end of each of the conductive wires 124 may be coupled to a cable connector 110. Cable connector 110 may include a printed circuit board (PCB) 210 (e.g., paddle card). Cable connector 110 may include contacts 212 disposed on the PCB 210. The second distal end (e.g., smaller thickness) of the conductive wires 124 may be coupled with the contacts 212 on the PCB 210. In some embodiments, a corresponding second distal end of each of the conductive wires 124 may terminate at a corresponding pin (e.g., pin terminated cable) and the corresponding pin may be connected to a corresponding contact 212 on the PCB 210. In some embodiments, a corresponding second distal end of each of the conductive wires 124 is connected to a corresponding contact 212 on the PCB 210.

In some embodiments, the cable connector 110 includes contacts 212 to couple to a component (e.g., computing device, memory device, other device, etc.). In some embodiments, the cable connector includes pins to couple to a component (e.g., computing device, memory device, other device, etc.) and each of the pins may be coupled to a corresponding second distal end of a conductive wire 124.

The PCB 210 may be disposed within a housing. A first distal end of the contacts 212 may be connected to the conductive wires 124 and a second distal end of the contacts 212 may be exposed (e.g., extend out of the housing). For example, the contacts 212 may be gold fingers (e.g., gold plated connectors on the edge of PCB 210). The contacts 212 may engage with a connector on another PCB (e.g., a motherboard, etc.).

Figure 3A:
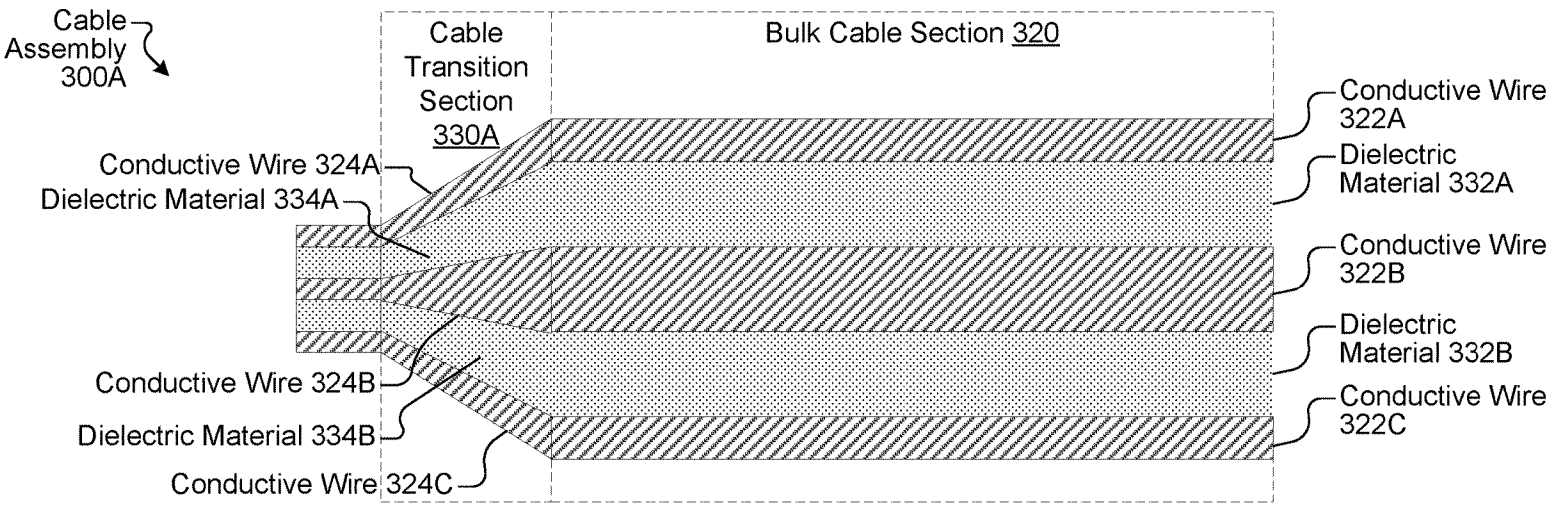
FIG. 3A illustrates a cross-sectional view of a cable assembly including a cable transition section, according to certain embodiments.
Figure 3B:
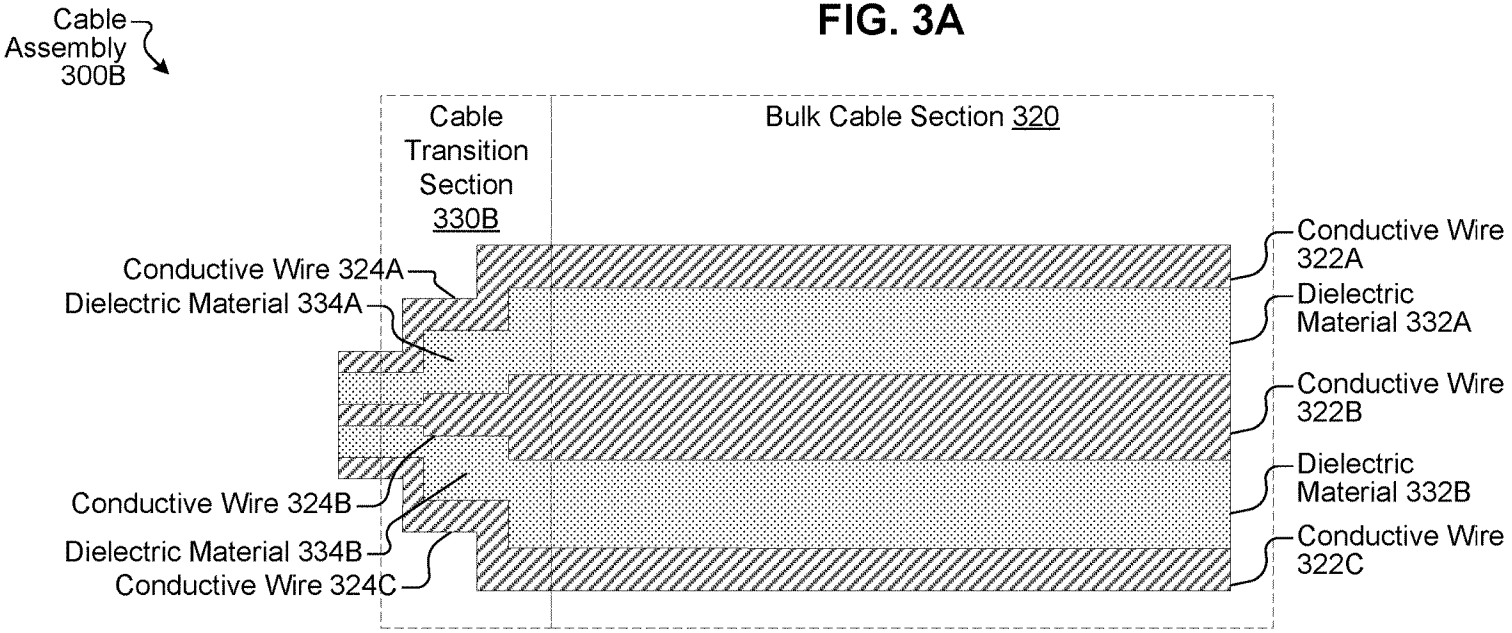
FIG. 3B illustrates a cross-sectional view of a cable assembly including a cable transition section, according to certain embodiments.

FIGS. 3A-B illustrate cross-sectional views of cable assemblies 300A and 300B (hereinafter "cable assembly 300") that include a corresponding cable transition section 330A and 330B (hereinafter "cable transition section 330"), according to certain embodiments.

Cable assembly 300 has a bulk cable section 320 (e.g., bulk cable section 120) including conductive wires 322 (e.g., conductive wires 122) and dielectric material 332 disposed between the conductive wires 322. Cable assembly 300 has a cable transition section 330 (e.g., cable transition section 130) that includes conductive wires 324 (e.g., conductive wires 124) and dielectric 334 disposed between the conductive wires.

In some embodiments a dielectric material 332A is disposed between conductive wire 322A and conductive wire 322B and a dielectric material 332B is disposed between conductive wire 322B and conductive wire 322C. In some embodiments, dielectric material 332A is the same as dielectric material 332B. In some embodiments, conductive wires 322A and 322C are both the same distance from conductive wire 322B as each other. In some embodiments, conductive wires 322A and 322C are the same conductive wire (e.g., that forms a cylinder) that is concentric around conductive wire 322B. Conductive wire 322B may be an inner inductor and the concentric wire 322A and 322C may be an outer inductor.

In some embodiments a dielectric material 334A is disposed between conductive wire 324A and conductive wire 324B and a dielectric material 334B is disposed between conductive wire 324B and conductive wire 324C. In some embodiments, dielectric material 334A is the same as dielectric material 334B. In some embodiments, conductive wires 324A and 324C are both the same distance from conductive wire 324B as each other. In some embodiments, conductive wires 324A and 324C are the same conductive wire (e.g., that forms a cylinder) that is concentric around conductive wire 324B. In some embodiments, cable assembly 300 is a micro coaxial cable (e.g., a twisted pair, etc.). Conductive wire 324B may be an inner inductor and the conductive wire 324A and 324C may be an outer inductor.

The impedance (e.g., differential impedance) of the cable transition section 330 may be maintained to meet the target impedance of the cable assembly 300 to avoid reflections from the cable transition section 330. To maintain impedance of the cable transition section 330, the geometry of the conductive wires 322 (e.g., the inner conductor and the outer conductor) is to be adjusted accordingly (maintain same relative distance between conductive wires 324 in the cable transition section 330 as is between conductive wires 322 in the bulk cable section). The length in the cable transition section 330 (e.g., distance between first and second distal ends of conductive wires 324) may be determined by the size of the connector and build (e.g., based on the housing, etc.).

Referring to FIG. 3A, the cable transition section 330A may include a smooth transition approach (e.g., a tapered transition). Cable transition section 330A may include a gradual cable transition of the conductive wires 324 with constant impedance during the transition.

Referring to FIG. 3B, the cable transition section 330B may include a segmented (e.g., stepped) transition approach. Cable transition section 330B may include a segmented cable transition of the conductive wires 324 with substantially the same impedance for each segment (e.g., each step of the stepped transition).

Figure 4:
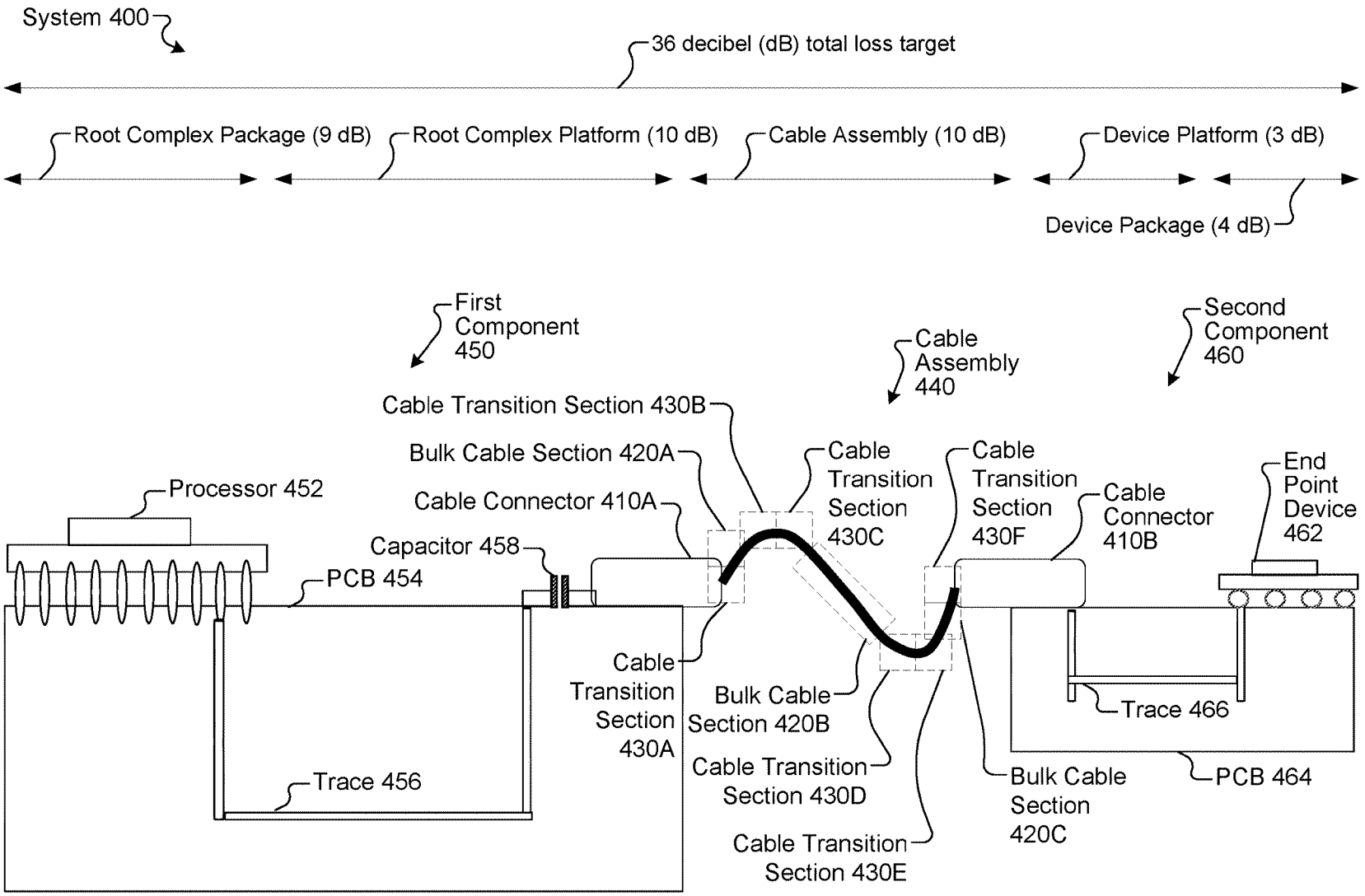
FIG. 4 illustrates a system including a cable assembly that includes a cable transition section, according to certain embodiments.

FIG. 4 illustrates a system 400 including a cable assembly 440 that includes a one or more cable transition sections 430, according to certain embodiments. In some embodiments, system 400 is a cabled topology with a loss target (e.g., 36 decibel (dB) loss target).

System 400 may include a cable assembly 440 disposed between a first component 450 and a second component 460. The first component 450 may transmit signals to the second component 460 via the cable assembly 440. The second component 460 may transmit signals to the first component 450 via the cable assembly 440.

The first component 450 may be a computing device. The first component 450 may include a processor 452 (e.g., root complex) disposed on a PCB 454. The processor 452 may be coupled (e.g., via pins) to a trace 456 disposed within the PCB 454. The trace 456 may couple with a capacitor 458 that couples with cable connector 410A. In some embodiments, the trace 456 couples with the cable connector 410A (e.g., without a capacitor 458).

The second component 460 may be another device (e.g., an end-point device, a memory device, a computing device, etc.). The second component 460 may include an end point device 462 disposed on a PCB 464. The end point device 462 may be coupled (e.g., via ball grid array (BGA) solder balls, etc.) to a trace 466 disposed within the PCB 464. The trace 466 may couple with cable connector 410B.

The cable assembly 440 may include a cable connectors 410A and 410B (hereinafter "cable connectors 410") (e.g., see cable connectors 110 in FIG. 1), one or more bulk cable sections 420 (e.g., see bulk cable sections 120 in FIG. 1), and one or more cable transition sections 430 (e.g., see cable transition section 130 in FIG. 1). The cable connectors 410 may be high-density connectors (HDC) (e.g., connectors with a high-density pin layout, connectors with a high density contact layout, connectors to couple with a small form factor device, etc.). The cable assembly 440 may include a corresponding cable transition section 430 proximate one or more of cable connectors 410 to enable a high-density connection (e.g., cable transition section 430A proximate the cable connector 410A and cable transition section 430F proximate the cable connector 410B). Cable assembly 440 may include a corresponding pair of cable transition sections 430 at one or more locations (e.g., bends)

in the cable assembly 440 to enable bending of the cable assembly 440 (e.g., a first pair of cable transition sections 430B and 430C at a first bend and a second pair of cable transition sections 430D and 430E at a second bend). The cable assembly 440 may have one or more bulk cable sections 420 (e.g., between cable transition sections 430A and 430B, between cable transition sections 430C and 430D, between cable transition sections 430E and 430F, etc.).

In some embodiments, system 400 is a cabled topology with a loss target. For example, system 400 may have a total loss target of 36 dB at 16 GHz from pad to pad. Within the 36 dB target, 9 dB is for the root complex package (e.g., processor 452) and 3 dB is for the device package (e.g., end point device 462), which leaves 23 dB for total routing and components. The root complex platform (e.g., PCB 454, trace 456, capacitor 458, etc.) may have a loss of 10 dB and the device platform (e.g., PCB 464, trace 466, etc.) may have a loss of 3 dB. This leaves a 10 dB loss available for the cable assembly. Each connector 410 may have 1.5 dB loss. One or more of the first component 450 or second component 460 may have a high-density connection (e.g., high density pins, high density contacts, small form factor) that is to connect to a cable connector 410 that is a high density connector.

Different thicknesses of conductive wire may have different amounts of loss. For example, Table 1 illustrates loss for different sizes in American wire gauge (AWG).

TABLE 1

| Cable Type | AWG Number | Loss at 10 GHz (dB/m) | Loss at 20 GHz (dB/m) |
|---|---|---|---|
| Twin-axial | 26 | 6.6 | 11.2 |
| Twin-axial | 28 | 9.1 | 15.0 |
| Twin-axial | 30 | 11.3 | 19.9 |
| Twin-axial | 34 | 13.5 | 24.0 |
| Micro-coaxial | 30 | 5.9 | 9.2 |
| Micro-coaxial | 32 | 7.2 | 11.0 |
| Micro-coaxial | 34 | 8.7 | 13.5 |
| Micro-coaxial | 38 | 19.7 | 31.9 |

As shown in Table 1, lower gauge (thicker conductive wire) has lower loss. Use of a cable transition section 430 allows use of thicker conductive wires in the bulk cable section 420, even with a small form factor connector or high-density pins.

A maximum wire thickness of 34 gauge (e.g., AWG34) (e.g., bulk cable section without a cable transition section 430) may be able to connect to the cable connector 410. At AWG34, the cable assembly may have a maximum length of 14 inches (in) to stay within the total loss target (e.g., maximum of 36 dB total loss target, 10 dB for the cable assembly). To have a thicker wire thickness (lower gauge), a cable assembly 440 with one or more cable transition sections 430 may be used (e.g., to have less loss and connect to a high density connector). For example, at AWG30, the cable assembly 440 may have a maximum length of 18 in to stay within the total loss target. In another example, at AWG28, the cable assembly 440 may have a maximum length of 22 in to stay within the total loss target. System 400 may have greater than a 50% longer cable assembly by using cable transition sections 430.

FIG. 5 illustrates a system 500 including cable assemblies that each includes one or more corresponding cable transition sections, according to certain embodiments.

System 500 includes a computing rack 510 and a computing rack 520. Although two computing racks are illustrated in FIG. 5, one or more computing racks can be used in system 500. Computing rack 510 may include one or more of computing devices 512A-Z (hereinafter "computing device 512"), memory devices 514A-Z (hereinafter "memory device 514"), or other devices 516A-Z (hereinafter "other device 516"). Computing rack 520 may include one or more of computing devices 522A-Z (hereinafter "computing device 522"), memory devices 524A-Z (hereinafter "memory device 524"), or other devices 526A-Z (hereinafter "other device 526"). Computing devices 512 and 522 may include any processing element, such as a microprocessor, a host processor, an embedded processor, a co-processor, or other processor. Memory devices 514 and 524 may include any memory device, such as random access memory (RAM), non-volatile (NV) memory, or other memory accessible by devices in system 500. Other devices 516 and 526 may include an end point device, controller hub, etc.

Two or more of computing devices 512, memory devices 514, other devices 516, computing devices 522, memory devices 524, and other devices 526 may be connected via a cable assembly 540 (e.g., cable assembly 100 of FIGS. 1A-B, cable assembly 200 of FIG. 2, cable assemblies 300 of FIGS. 3A-B, cable assembly 440 of FIG. 4, etc.).

In some embodiments, a computing device 512A of computing rack 510 is coupled to other device 526Z of computing rack 520 via a cable assembly 540A. In some embodiments, computing device 512A of computing rack 510 is coupled to a computing device 522A of computing rack 520 via a cable assembly 540B. In some embodiments, computing device 512A of computing rack 510 is coupled to a memory device 522Z of computing rack 510 via a cable assembly 540C.

Each of the cable assemblies 540 may include one or more cable transition sections 530. For example, cable assembly 540A may include a cable transition section 530A at the cable connector proximate computing device 512A, a cable transition section 530J at the cable connector proximate other device 526Z, and one or more pairs of cable transition sections 530 (e.g., cable transition sections 530B-C, 530D-E, 530F-G, and 530H-I). In another example, cable assembly 540B may include a cable transition section 530K at the cable connector proximate computing device 512A and a cable transition section 530L at the cable connector proximate computing device 522A. In another example, cable assembly 540C may include a cable transition section 530M at the cable connector proximate computing device 512A, a cable transition section 530R at the cable connector proximate memory device 514Z, and one or more pairs of cable transition sections 530 (e.g., cable transition sections 530N-O and 530P-Q).

The following examples pertain to further embodiments.

Example 1 is a cable assembly comprising: a first cable connector to couple to a first component; a bulk cable section comprising a first plurality of conductive wires of a first wire thickness; and a first cable transition section comprising a second plurality of conductive wires that has a first distal end connected to the bulk cable section and a second distal end connected to the first cable connector, wherein each of the second plurality of conductive wires transitions from the first wire thickness at the first distal end to a second wire thickness that is less than the first wire thickness at the second distal end, wherein each of the second plurality of conductive wires in the first distal end is connected to a corresponding conductive wire of the first plurality of conductive wires.

In Example 2, the subject matter of Example 1 further comprising: a second cable connector to couple to a second component; and a second cable transition section comprising a third plurality of conductive wires that has a third distal end connected to the bulk cable section and a fourth distal end connected to the second cable connector, wherein each of the third plurality of conductive wires transitions from the first wire thickness at the third distal end to a third wire thickness that is less than the first wire thickness at the fourth distal end, wherein each of the third plurality of conductive wires in the third distal end is connected to the corresponding conductive wire of the first plurality of conductive wires.

In Example 3, the subject matter of any one of Examples 1-2, wherein the first cable connector comprises a printed circuit board and a plurality of conductors disposed on the printed circuit board, wherein each of the second plurality of conductive wires at the second distal end of the first cable transition section are connected to a respective conductor of the plurality of conductors of the first cable connector.

In Example 4, the subject matter of any one of Examples 1-3, wherein: dielectric is disposed between respective adjacent conductive wires of the first plurality of conductive wires and is disposed between the respective adjacent conductive wires of the second plurality of conductive wires; and a first dielectric-to-conductive-wire ratio of the first plurality of conductive wires is substantially same as a second dielectric-to-conductive-wire ratio of the second plurality of conductive wires.

In Example 5, the subject matter of any one of Examples 1-4, wherein a first differential impedance of the first plurality of conductive wires substantially matches a second differential impedance of the second plurality of conductive wires.

In Example 6, the subject matter of any one of Examples 1-5, wherein each conductive wire of the second plurality of wires in the first cable transition section has a tapered transition from the first wire thickness to the second wire thickness.

In Example 7, the subject matter of any one of Examples 1-6, wherein each conductive wire of the second plurality of wires in the first cable transition section has a stepped transition from the first wire thickness to the second wire thickness.

Example 8 is a system comprising: a first component; a second component; and a cable assembly comprising: a first cable connector to couple to the first component; a second cable connector to couple to the second component; one or more bulk cable sections, wherein each of the one or more bulk cable sections comprises a respective first plurality of conductive wires of a first wire thickness; and one or more cable transition sections, wherein: each of the one or more cable transition sections comprises a respective second plurality of conductive wires that has a respective first distal end of the first wire thickness and a respective second distal end of a second wire thickness that is less than the first wire thickness; each of the respective second plurality of conductive wires transitions from the first wire thickness at the respective first distal end to the second wire thickness at the respective second distal end; the respective first distal end connects to the respective first plurality of conductive wires; and the first component is to transmit a plurality of signals to the second component by transmitting the plurality of signals from the first cable connector to the second cable connector via the one or more cable transition sections and the one or more bulk cable sections.

In Example 9, the subject matter of Example 8, wherein the respective second distal end of a first cable transition section of the one or more cable transition sections connects to the first cable connector.

In Example 10, the subject matter of any one of Examples 8-9, wherein the respective second distal end of a second cable transition section of the one or more cable transition sections connects to the second cable connector.

In Example 11, the subject matter of any one of Examples 8-10, wherein the first cable connector comprises a printed circuit board and a plurality of conductors disposed on the printed circuit board, wherein each of the respective second plurality of conductive wires at the respective second distal end of the first cable transition section are connected to a respective conductor of the plurality of conductors of the first cable connector.

In Example 12, the subject matter of any one of Examples 8-11, wherein: the respective first distal end of a third cable transition section of the one more cable transition sections connects to a first bulk cable section of the one or more bulk cable sections; the respective first distal end of a fourth cable transition section of the one more cable transition sections connects to a second bulk cable section of the one or more bulk cable sections; and the respective second distal end of the third cable transition section connects to the respective second distal end of the fourth cable transition section.

In Example 13, the subject matter of any one of Examples 8-12, wherein: dielectric is disposed between respective adjacent conductive wires of the respective first plurality of conductive wires and is disposed between the respective adjacent conductive wires of the respective second plurality of conductive wires; and a first dielectric-to-conductive-wire ratio of the respective first plurality of conductive wires is substantially same as a second dielectric-to-conductive-wire ratio of the respective second plurality of conductive wires.

In Example 14, the subject matter of any one of Examples 8-13, wherein a first differential impedance of the respective first plurality of conductive wires substantially matches a second differential impedance of the respective second plurality of conductive wires.

In Example 15, the subject matter of any one of Examples 8-14, wherein each conductive wire of the respective second plurality of wires in each of the one or more cable transition sections has a tapered transition from the first wire thickness to the second wire thickness.

In Example 16, the subject matter of any one of Examples 8-15, wherein each conductive wire of the respective second plurality of wires in each of the one or more cable transition sections has a stepped transition from the first wire thickness to the second wire thickness.

Example 17 is a cable assembly comprising: a first bulk cable section comprising a first plurality of conductive wires of a first wire thickness; a first cable transition section comprising a second plurality of conductive wires that has a first distal end connected to the first bulk cable section and a second distal end, wherein each of the second plurality of conductive wires transitions from the first wire thickness at the first distal end to a second wire thickness that is less than the first wire thickness at the second distal end, wherein each of the second plurality of conductive wires in the first distal end is connected to a corresponding conductive wire of the first plurality of conductive wires; a second cable transition section comprising a third plurality of conductive wires that has a third distal end connected to the second distal end of the second plurality of conductive wires and a fourth distal end, wherein each of the second plurality of conductive wires transitions from the second wire thickness at the third distal end to a third wire thickness that is greater than the second wire thickness at the fourth distal end, wherein each of the third plurality of conductive wires in the third distal end is connected to the corresponding conductive wire of the second plurality of conductive wires; and a second bulk cable section comprising a fourth plurality of conductive wires of the third wire thickness, wherein each of the fourth plurality of conductive wires is connected to the corresponding conductive wire of the third plurality of conductive wires.

In Example 18, the subject matter of Example 17, wherein: dielectric is disposed between respective adjacent conductive wires of the first plurality of conductive wires and is disposed between the respective adjacent conductive wires of the second plurality of conductive wires; and a first dielectric-to-conductive-wire ratio of the first plurality of conductive wires is substantially same as a second dielectric-to-conductive-wire ratio of the second plurality of conductive wires.

In Example 19, the subject matter of any one of Examples 17-18, wherein a first differential impedance of the first plurality of conductive wires substantially matches a second differential impedance of the second plurality of conductive wires.

In Example 20, the subject matter of any one of Examples 17-19, wherein each conductive wire of the second plurality of wires in the first cable transition section has a tapered transition from the first wire thickness to the second wire thickness.

Various embodiments can have different combinations of the structural features described above. For instance, all optional features of the computing system described above can also be implemented with respect to the method or process described herein and specifics in the examples can be used anywhere in one or more embodiments.

While the present disclosure has been described with respect to a limited number of embodiments, those skilled in the art will appreciate numerous modifications and variations therefrom. It is intended that the appended claims cover all such modifications and variations as fall within the true spirit and scope of this present disclosure.

In the description herein, numerous specific details are set forth, such as examples of specific types of processors and system configurations, specific hardware structures, specific architectural and micro architectural details, specific register configurations, specific instruction types, specific system components, specific measurements/heights, specific processor pipeline stages and operation etc. in order to provide a thorough understanding of the present disclosure. It will be apparent, however, to one skilled in the art that these specific details need not be employed to practice the present disclosure. In other instances, well known components or methods, such as specific and alternative processor architectures, specific logic circuits/code for described algorithms, specific firmware code, specific interconnect operation, specific logic configurations, specific manufacturing techniques and materials, specific compiler embodiments, specific expression of algorithms in code, specific power down and gating techniques/logic and other specific operational details of computer system have not been described in detail in order to avoid unnecessarily obscuring the present disclosure.

The embodiments may be described with reference to components in high speed I/O (HSIO) devices in specific integrated circuits, such as in computing platforms or microprocessors. The embodiments can also be applicable to other types of integrated circuits and programmable logic devices. For example, the disclosed embodiments are not limited to data center systems, desktop computer systems, or portable computers, such as the Intel® Ultrabooks™ computers, and can be also used in other devices, such as handheld devices, tablets, other thin notebooks, systems on a chip (SoC) devices, and embedded applications. Some examples of handheld devices include cellular phones, Internet protocol devices, digital cameras, personal digital assistants (PDAs), and handheld PCs. Embedded applications typically include a microcontroller, a digital signal processor (DSP), a system on a chip, network computers (NetPC), set-top boxes, network hubs, wide area network (WAN) switches, or any other system that can perform the functions and operations taught below. It is described that the system can be any kind of computer or embedded system. The disclosed embodiments can especially be used for low-end devices, like wearable devices (e.g., watches), electronic implants, sensory and control infrastructure devices, controllers, supervisory control and data acquisition (SCADA) systems, or the like. Moreover, the apparatuses, methods, and systems described herein are not limited to physical computing devices, but can also relate to software optimizations for energy conservation and efficiency. As will become readily apparent in the description below, the embodiments of methods, apparatuses, and systems described herein (whether in reference to hardware, firmware, software, or a combination thereof) are vital to a 'green technology' future balanced with performance considerations.

Although the embodiments herein are described with reference to a processor, other embodiments are applicable to other types of integrated circuits and logic devices. Similar techniques and teachings of embodiments of the present disclosure can be applied to other types of circuits or semiconductor devices that can benefit from higher pipeline throughput and improved performance. The teachings of embodiments of the present disclosure are applicable to any processor or machine that performs data manipulations. However, the present disclosure is not limited to processors or machines that perform 512 bit, 256 bit, 128 bit, 64 bit, 32 bit, or 16 bit data operations and can be applied to any processor and machine in which manipulation or management of data is performed. In addition, the description herein provides examples, and the accompanying drawings show various examples for the purposes of illustration. However, these examples should not be construed in a limiting sense as they are merely intended to provide examples of embodiments of the present disclosure rather than to provide an exhaustive list of all possible embodiments of embodiments of the present disclosure.

A module as used herein refers to any combination of hardware, software, and/or firmware. As an example, a module includes hardware, such as a micro-controller, associated with a non-transitory medium to store code adapted to be executed by the micro-controller. Therefore, reference to a module, in one embodiment, refers to the hardware, which is specifically configured to recognize and/or execute the code to be held on a non-transitory medium. Furthermore, in another embodiment, use of a module refers to the non-transitory medium including the code, which is specifically adapted to be executed by the microcontroller to perform predetermined operations. And as can be inferred, in yet another embodiment, the term module (in this example) can refer to the combination of the microcontroller and the non-transitory medium. Often module boundaries that are illustrated as separate commonly vary and potentially overlap. For example, a first and a second module can share hardware, software, firmware, or a combination thereof, while potentially retaining some independent hardware, software, or firmware. In one embodiment, use of the term logic includes hardware, such as transistors, registers, or other hardware, such as programmable logic devices.

Use of the phrase 'configured to,' in one embodiment, refers to arranging, putting together, manufacturing, offering to sell, importing and/or designing an apparatus, hardware, logic, or element to perform a designated or determined task. In this example, an apparatus or element thereof that is not operating is still 'configured to' perform a designated task if it is designed, coupled, and/or interconnected to perform said designated task. As a purely illustrative example, a logic gate can provide a 0 or a 1 during operation. But a logic gate 'configured to' provide an enable signal to a clock does not include every potential logic gate that can provide a 1 or 0. Instead, the logic gate is one coupled in some manner that during operation the 1 or 0 output is to enable the clock. Note once again that use of the term 'configured to' does not require operation, but instead focus on the latent state of an apparatus, hardware, and/or element, where in the latent state the apparatus, hardware, and/or element is designed to perform a particular task when the apparatus, hardware, and/or element is operating.

Furthermore, use of the phrases 'to,' 'capable of/to,' and or 'operable to,' in one embodiment, refers to some apparatus, logic, hardware, and/or element designed in such a way to enable use of the apparatus, logic, hardware, and/or element in a specified manner. Note as above that use of to, capable to, or operable to, in one embodiment, refers to the latent state of an apparatus, logic, hardware, and/or element, where the apparatus, logic, hardware, and/or element is not operating but is designed in such a manner to enable use of an apparatus in a specified manner.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics can be combined in any suitable manner in one or more embodiments.

In the foregoing specification, a detailed description has been given with reference to specific exemplary embodiments. It will, however, be evident that various modifications and changes can be made thereto without departing from the broader spirit and scope of the disclosure as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but can refer to different and distinct embodiments, as well as potentially the same embodiment.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here and generally, conceived to be a self-consistent sequence of operations leading to a desired result. The operations are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers or the like. The blocks described herein can be hardware, software, firmware or a combination thereof.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "contacting," "coupling," "conducting," "transmitting," "receiving," or the like, refer to the actions and processes of a computing system, or similar electronic computing device, that manipulates and transforms data represented as physical (e.g., electronic) quantities within the computing system's registers and memories into other data similarly represented as physical quantities within the computing system memories or registers or other such information storage, transmission or display devices.

The words "example" or "exemplary" are used herein to mean serving as an example, instance or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Also, the terms "first," "second," "third," "fourth," etc. as used herein are meant as labels to distinguish among different elements and can not necessarily have an ordinal meaning according to their numerical designation.

What is claimed is:

1. A cable assembly comprising:

a first cable connector to couple to a first component;

a bulk cable section comprising a first plurality of conductive wires of a first wire thickness; and a first cable transition section comprising a second plurality of conductive wires that has a first distal end connected to the bulk cable section and a second distal end connected to the first cable connector, wherein each of the second plurality of conductive wires transitions from the first wire thickness at the first distal end to a second wire thickness that is less than the first wire thickness at the second distal end, wherein each of the second plurality of conductive wires in the first distal end is connected to a corresponding conductive wire of the first plurality of conductive wires.

2. The cable assembly of claim 1 further comprising:

a second cable connector to couple to a second component; and a second cable transition section comprising a third plurality of conductive wires that has a third distal end connected to the bulk cable section and a fourth distal end connected to the second cable connector, wherein each of the third plurality of conductive wires transitions from the first wire thickness at the third distal end to a third wire thickness that is less than the first wire thickness at the fourth distal end, wherein each of the third plurality of conductive wires in the third distal end is connected to the corresponding conductive wire of the first plurality of conductive wires.

3. The cable assembly of claim 1, wherein the first cable connector comprises a printed circuit board and a plurality of conductors disposed on the printed circuit board, wherein each of the second plurality of conductive wires at the second distal end of the first cable transition section are connected to a respective conductor of the plurality of conductors of the first cable connector.

4. The cable assembly of claim 1, wherein:

dielectric is disposed between respective adjacent conductive wires of the first plurality of conductive wires and is disposed between the respective adjacent conductive wires of the second plurality of conductive wires; and a first dielectric-to-conductive-wire ratio of the first plurality of conductive wires is substantially same as a second dielectric-to-conductive-wire ratio of the second plurality of conductive wires.

5. The cable assembly of claim 1, wherein a first differential impedance of the first plurality of conductive wires substantially matches a second differential impedance of the second plurality of conductive wires.

6. The cable assembly of claim 1, wherein each conductive wire of the second plurality of wires in the first cable transition section has a tapered transition from the first wire thickness to the second wire thickness.

7. The cable assembly of claim 1, wherein each conductive wire of the second plurality of wires in the first cable transition section has a stepped transition from the first wire thickness to the second wire thickness.

8. A system comprising:

a first component;

a second component; and a cable assembly comprising:

a first cable connector to couple to the first component;

a second cable connector to couple to the second component;

one or more bulk cable sections, wherein each of the one or more bulk cable sections comprises a respective first plurality of conductive wires of a first wire thickness; and one or more cable transition sections, wherein:

each of the one or more cable transition sections comprises a respective second plurality of conductive wires that has a respective first distal end of the first wire thickness and a respective second distal end of a second wire thickness that is less than the first wire thickness;

each of the respective second plurality of conductive wires transitions from the first wire thickness at the respective first distal end to the second wire thickness at the respective second distal end;

the respective first distal end connects to the respective first plurality of conductive wires; and the first component is to transmit a plurality of signals to the second component by transmitting the plurality of signals from the first cable connector to the second cable connector via the one or more cable transition sections and the one or more bulk cable sections.

9. The system of claim 8, wherein the respective second distal end of a first cable transition section of the one or more cable transition sections connects to the first cable connector.

10. The system of claim 9, wherein the respective second distal end of a second cable transition section of the one or more cable transition sections connects to the second cable connector.

11. The system of claim 9, wherein the first cable connector comprises a printed circuit board and a plurality of conductors disposed on the printed circuit board, wherein each of the respective second plurality of conductive wires at the respective second distal end of the first cable transition section are connected to a respective conductor of the plurality of conductors of the first cable connector.

12. The system of claim 8, wherein:

the respective first distal end of a third cable transition section of the one more cable transition sections connects to a first bulk cable section of the one or more bulk cable sections;

the respective first distal end of a fourth cable transition section of the one more cable transition sections connects to a second bulk cable section of the one or more bulk cable sections; and the respective second distal end of the third cable transition section connects to the respective second distal end of the fourth cable transition section.

13. The system of claim 8, wherein:

dielectric is disposed between respective adjacent conductive wires of the respective first plurality of conductive wires and is disposed between the respective adjacent conductive wires of the respective second plurality of conductive wires; and a first dielectric-to-conductive-wire ratio of the respective first plurality of conductive wires is substantially same as a second dielectric-to-conductive-wire ratio of the respective second plurality of conductive wires.

14. The system of claim 8, wherein a first differential impedance of the respective first plurality of conductive wires substantially matches a second differential impedance of the respective second plurality of conductive wires.

15. The system of claim 8, wherein each conductive wire of the respective second plurality of wires in each of the one or more cable transition sections has a tapered transition from the first wire thickness to the second wire thickness.

16. The system of claim 8, wherein each conductive wire of the respective second plurality of wires in each of the one or more cable transition sections has a stepped transition from the first wire thickness to the second wire thickness.

17. A cable assembly comprising:

a first bulk cable section comprising a first plurality of conductive wires of a first wire thickness;

a first cable transition section comprising a second plurality of conductive wires that has a first distal end connected to the first bulk cable section and a second distal end, wherein each of the second plurality of conductive wires transitions from the first wire thickness at the first distal end to a second wire thickness that is less than the first wire thickness at the second distal end, wherein each of the second plurality of conductive wires in the first distal end is connected to a corresponding conductive wire of the first plurality of conductive wires;

a second cable transition section comprising a third plurality of conductive wires that has a third distal end connected to the second distal end of the second plurality of conductive wires and a fourth distal end, wherein each of the second plurality of conductive wires transitions from the second wire thickness at the third distal end to a third wire thickness that is greater than the second wire thickness at the fourth distal end, wherein each of the third plurality of conductive wires in the third distal end is connected to the corresponding conductive wire of the second plurality of conductive wires; and a second bulk cable section comprising a fourth plurality of conductive wires of the third wire thickness, wherein each of the fourth plurality of conductive wires is connected to the corresponding conductive wire of the third plurality of conductive wires.

18. The cable assembly of claim 17, wherein:

dielectric is disposed between respective adjacent conductive wires of the first plurality of conductive wires and is disposed between the respective adjacent conductive wires of the second plurality of conductive wires; and a first dielectric-to-conductive-wire ratio of the first plurality of conductive wires is substantially same as a second dielectric-to-conductive-wire ratio of the second plurality of conductive wires.

19. The cable assembly of claim 17, wherein a first differential impedance of the first plurality of conductive wires substantially matches a second differential impedance of the second plurality of conductive wires.

20. The cable assembly of claim 17, wherein each conductive wire of the second plurality of wires in the first cable transition section has a tapered transition from the first wire thickness to the second wire thickness.

* * * * *